US009502755B2

(12) United States Patent
Hibbard, Jr. et al.

(10) Patent No.: US 9,502,755 B2
(45) Date of Patent: Nov. 22, 2016

(54) AUTOMOTIVE RADIO ANTENNA AND METHOD FOR MAKING THE SAME

(71) Applicant: GM GLOBAL TECHNOLOGY OPERATIONS LLC, Detroit, MI (US)

(72) Inventors: Donald B. Hibbard, Jr., Howell, MI (US); Gregg R. Kittinger, Pontiac, MI (US); David J. Trzcinski, Howell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 226 days.

(21) Appl. No.: 14/163,848

(22) Filed: Jan. 24, 2014

(65) Prior Publication Data

US 2015/0214605 A1 Jul. 30, 2015

(51) Int. Cl.
*H01Q 1/32* (2006.01)
*H01Q 9/04* (2006.01)

(52) U.S. Cl.
CPC ..... *H01Q 1/32* (2013.01); *H01Q 1/3291* (2013.01); *H01Q 9/0407* (2013.01); *Y10T 29/49016* (2015.01)

(58) Field of Classification Search
CPC ..... H01Q 1/32
USPC ..... 343/711–714
See application file for complete search history.

(56) References Cited

U.S. PATENT DOCUMENTS

| | | | | |
|---|---|---|---|---|
| 4,507,341 | A | 3/1985 | Heseltine | |
| 4,609,586 | A * | 9/1986 | Jensen | H05K 1/056 428/209 |
| 5,291,210 | A * | 3/1994 | Nakase | H01Q 9/40 343/700 MS |
| 5,706,015 | A * | 1/1998 | Chen | H01Q 1/3275 343/700 MS |
| 5,748,152 | A * | 5/1998 | Glabe | H01Q 13/085 343/705 |
| 5,757,327 | A * | 5/1998 | Yajima | H01Q 21/061 343/700 MS |
| 6,031,501 | A * | 2/2000 | Rausch | H01Q 3/40 343/753 |
| 6,357,764 | B1 * | 3/2002 | Gaines | H01Q 1/42 277/634 |
| 7,642,975 | B2 * | 1/2010 | Brunks | B64D 45/02 343/705 |
| 2003/0164801 | A1 * | 9/2003 | Jordan | H01Q 1/32 343/713 |
| 2004/0227670 | A1 * | 11/2004 | Higasa | H01Q 9/0435 343/700 MS |
| 2005/0267600 | A1 * | 12/2005 | Haberman | A61F 2/76 623/38 |
| 2011/0187613 | A1 * | 8/2011 | Kittinger | H01Q 5/00 343/713 |

* cited by examiner

*Primary Examiner* — Huedung Mancuso
(74) *Attorney, Agent, or Firm* — Lorena & Kopf, LLP

(57) ABSTRACT

A method and system for increasing the performance of an automotive plate antenna system are provided. A carbon loaded material is used to enhance performance of the plate antenna. The method and resulting systems have a first metallic plate of the antenna arranged and secured on a planar surface of the carbon loaded material. The method realizes an antenna system with reduced size and weight without a reduction in performance.

15 Claims, 3 Drawing Sheets

AUTOMOTIVE RADIO ANTENNA AND METHOD FOR MAKING THE SAME

TECHNICAL FIELD

Embodiments of the subject matter described herein relate generally to radio antenna systems. More specifically, embodiments of the subject matter relate to automotive plate antenna systems having enhanced performance.

BACKGROUND

A common automotive radio antenna (hereinafter "antenna") comprises a conductive rod attached to the body of a vehicle. The body of the vehicle is generally conductive and serves as a ground plane for the antenna. The antenna receives signals from all directions substantially perpendicular to the axis of the antenna (i.e., primarily horizontally) in patterns referred to as lobes. The three dimensional space within which the signals are received or detected is referred to hereinafter as the capture area. A conductive rod antenna is a resonant antenna, which implies that a relationship exists between the wavelength of the desired signal reception and the length of the antenna. Generally, utilizing an antenna length of one quarter of the wavelength of the desired signal maximizes the reception of a resonant antenna within a single lobe. Therefore, resonant antennas are practical for short wavelengths, or high frequencies such as FM radio frequencies. For example, the FM frequency wavelengths range from approximately two to four meters, and the corresponding antenna length is usually approximately seventy-five centimeters. As wavelengths become longer, resonant antennas become less practical.

Frequencies below approximately 10 Mhz such as AM radio frequencies, have wavelengths that are too long to detect with a resonant antenna in an automobile application. A contemporary form factor for reception of AM signals in an automobile is a plate antenna. In contrast to the conductive rod antenna, a plate antenna is a non-resonant antenna that operates by detecting the voltage field between two plates. In automotive applications, the plate antenna includes a first metallic plate coupled to a metallic portion of the automotive frame. The capture area, or voltage field detection area, is substantially between the first metallic plate and the metallic portion of the automotive frame. Plate antennas are commonly integrated into the automotive structure (i.e., no portion extends outward from the vehicle). The location and placement of the first plate in a plate antenna is generally dictated by the size of the first plate.

In plate antenna design, the relationship between the capture area for voltage field detection and plate antenna size is approximately linear; therefore, maximizing plate antenna size is favored in design. Consequently, what is lacking is a method for increasing the plate antenna capture area without increasing the plate antenna size.

Accordingly, a method for increasing the plate antenna capture area without increasing the plate antenna size is desirable. Such a method would enable an antenna system that reduces the overall weight of the vehicle and increases the options for positioning of the antenna within the vehicle.

Other desirable features will become apparent from the following detailed description and the appended claims, taken in conjunction with the accompanying drawings and this background.

BRIEF SUMMARY

A method for increasing the performance of an automotive plate antenna of the type which includes a first metallic plate is provided. The first metallic plate is secured to a surface of a carbon loaded material.

An automotive antenna system is also provided. The system includes a carbon loaded material having a planar surface. A first metallic plate is arranged on the planar surface of the carbon loaded material, and a fastener is used to couple the carbon loaded material to the first metallic plate.

Another automotive antenna system is provided. The antenna system includes a fiber reinforced plastic panel having a planar surface. A first metallic plate is coupled to the planar surface of the fiber reinforced plastic panel.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

Other desirable features will become apparent from the following detailed description and the appended claims, taken in conjunction with the accompanying drawings and this background.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures and wherein:

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary, or the following detailed description.

The system and methods described herein can be deployed with any antenna system. The system and methods presented herein provide an increase in radio signal detection without a corresponding increase in the antenna size. In certain embodiments, the antenna plate is tightly coupled to a panel of the automotive body (hereinafter "panel"). In various embodiments, the panel contains carbon fibers. In other embodiments, the panel includes material that exhibits capacitive coupling properties. The antenna may be located anywhere on or within the vehicle. The panel may be any portion of the automotive structure.

Figure 1:
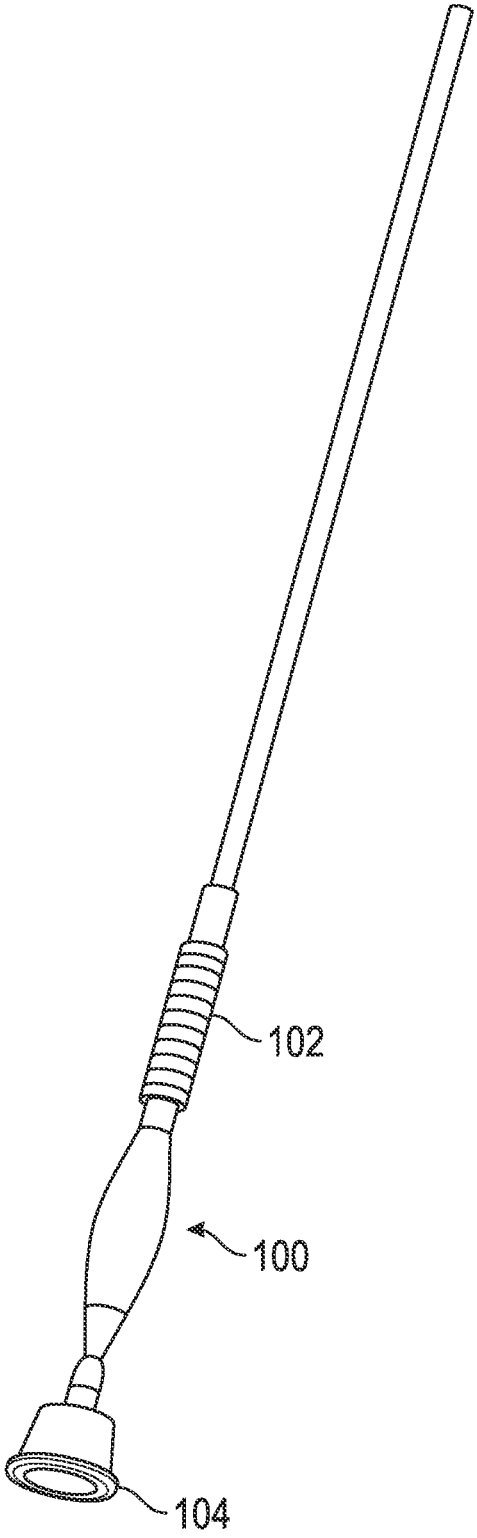
FIG. 1 is a diagram of a conductive rod antenna.

FIG. 1 is a diagram of a conductive rod antenna 100. For the sake of clarity and brevity, FIG. 1 does not depict the entire antenna system. Instead, FIG. 1 merely depicts some of the notable functional elements and components of a conductive rod antenna 100 that support the various features, functions, and operations described in more detail below. In this regard, the conductive rod antenna 100 may include, without limitation: an expandable, telescoping section 102, and a base section 104. In automotive use, a portion or panel of the automotive body serves as a conductive base for the conductive rod antenna 100; the conductive rod antenna 100 can be mounted by coupling the base section 104 to the exterior of the vehicle.

Figure 2:
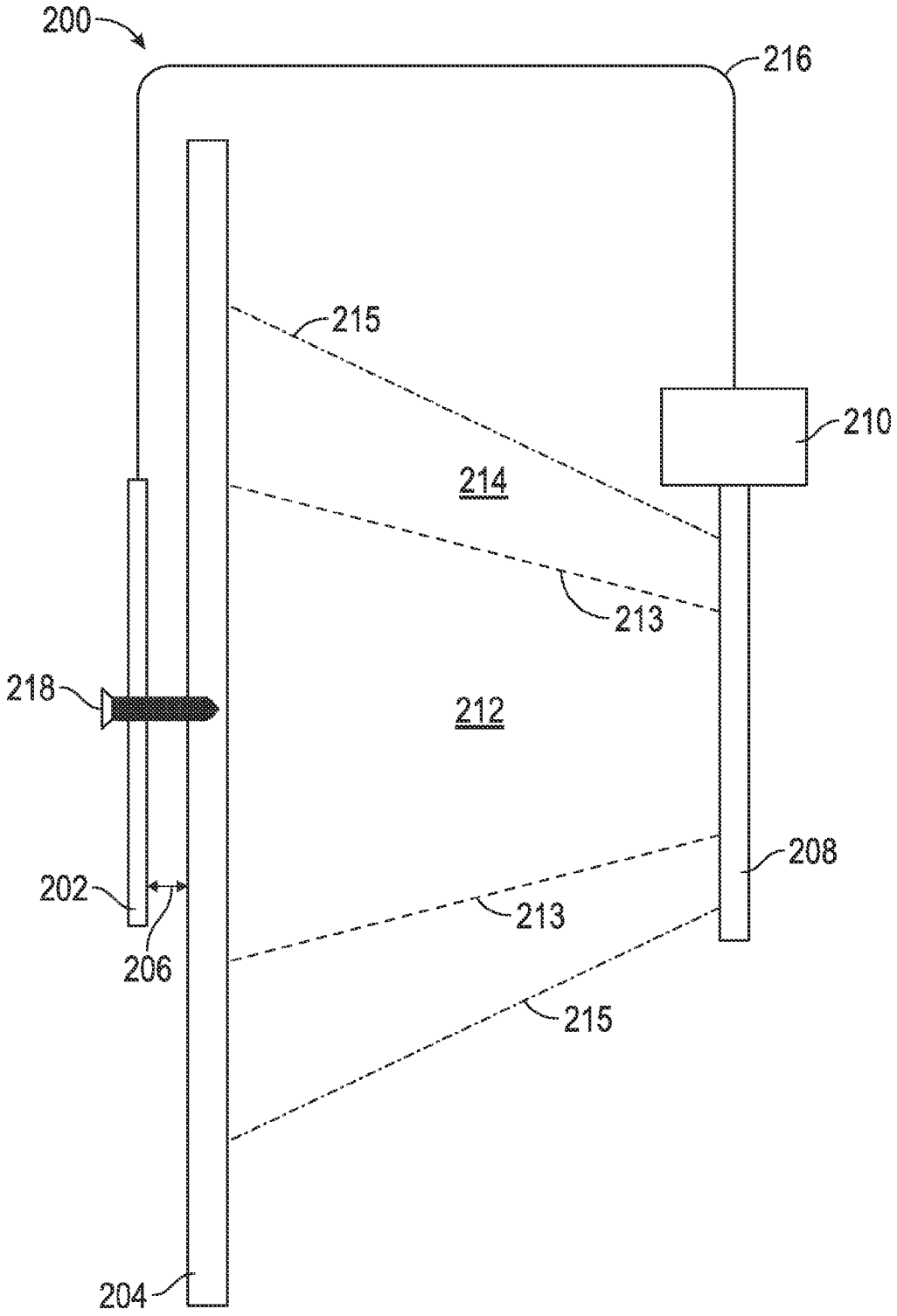
FIG. 2 is a block diagram of an exemplary embodiment of the automotive plate antenna system described herein.

FIG. 2 is a block diagram of an exemplary embodiment of an automotive plate antenna system 200. FIG. 2 includes a metallic plate 202 coupled via a conductor 216 to an antenna amplifier 210. Antenna amplifier 210 is coupled to a metallic structure 208, and the metallic plate 202 is coupled to panel 204 via a fastener 218. Metallic plate 202 is separated from panel 204 by a distance indicated by arrow 206. Region 212, bounded by dashed lines 213, and region 214, bounded by dotted lines 215, represent two different sized capture areas that are described hereinbelow.

Metallic plate 202 comprises the first plate in plate antenna system 200. In the exemplary embodiment, the frame of the vehicle serves as the second plate, shown as metallic structure 208. The capture area, or region for sensing voltage, is between the metallic plate 202 and the metallic structure 208. As described hereinabove, the general design rule favors maximizing the plate size; therefore, in practice, the metallic plate 202 is generally as large as can be accommodated by the available area at the antenna placement location. In some embodiments, the metallic plate 202 extends from a first side of a vehicle to a second side of a vehicle. In the exemplary embodiment, the resulting capture area for the plate antenna system 200 is represented as region 212.

The capture area shown as region 212 is simplified to illustrate signal detection as a measure of voltage between the two plates. The simplified region 212 depicts the capture area between the plates as if the boundaries are distinct. In practice, the capture area does not have distinct boundaries, but tapers off beyond the edges of the plates. Additionally, region 212 is simplified into a two dimensional area in FIG. 2, however, it can be readily appreciated that the capture area and the signals being detected by the two plates actually comprise a three-dimensional volume surrounding the metallic plate 202.

The metallic plate 202 is coupled to the body of the vehicle at a planar surface of panel 204, which may be a portion of the interior or exterior of the vehicle. In other embodiments, panel 204 is an injection molded fiber reinforced plastic panel. In some embodiments, panel 204 comprises microscopic grains of carbon, between which capacitive coupling can occur.

Panel 204 does not conduct D.C. current. As such, panel 204 is referred to as a carbon loaded material, as distinguished from electrically conductive carbon fiber cloth material. The carbon content in the material of panel 204 may vary. Results are noticeable when the carbon content of panel 204 is at least 20%, and become significant when panel 204 contains 40-50% carbon. The carbon content in the material of panel 204 may be in excess of 80%. Other materials that contain particles that exhibit capacitive coupling without conducting D.C. current may be utilized for panel 204, regardless of their carbon content (for example, resistive metallic film).

This method and the antenna system produced therefrom introduce using the conductive quality of the panel 204 to enhance the effective capture area of the plate antenna system 200. One exemplary method requires securing the metallic plate 202 to a planar surface of the panel 204. In another exemplary method, the metallic plate 202 and planar surface of the panel 204 are separated by a distance of substantially 0.15 millimeters (mm). Various fasteners and fastening techniques may be used to secure metallic plate 202 to panel 204 (e.g., threaded fasteners such as screws and bolts, or adhesives, and the like). The exemplary method utilizes a centrally placed threaded fastener as the fastener 218. The exemplary method further requires decreasing the distance by applying a torque of substantially 9 Newton-meters (Nm). As may be readily appreciated, the planarity and the smoothness of the panel and the metallic plate can affect the observable performance. Hereinafter, when utilizing this method, the metallic plate 202 and panel 204 are described as "tightly coupled." Tightly coupling the metallic plate to the carbon loaded panel as described herein results in an effective increase in the capture area of a given plate size. Consequently, this method increases the signal reception of the plate antenna. The resulting increase in capture area is depicted in FIG. 2 as region 214.

Performance of an antenna can be measured by signal gain. In one example, a conductive rod antenna was centrally placed on the roof of a vehicle as a reference, and signal reception of a plate antenna in the vehicle was measured and compared to the reference. The plate size was held constant. In a first trial, the plate was secured to foam, and in a second trial, the plate was secured to a carbon loaded panel as previously described. The carbon loaded panel material produced approximately a five dB improvement in gain over the plate on foam configuration. Other embodiments may produce different results.

The increase in capture area with respect to a plate antenna of a given size provides the ability to reduce the antenna size while still achieving the desired signal reception. A reduction in the metallic plate size of approximately 60% was achieved while still detecting the desired signals. A smaller metallic plate provides the benefit of less weight and provides more flexibility with respect to antenna location.

Figure 3:
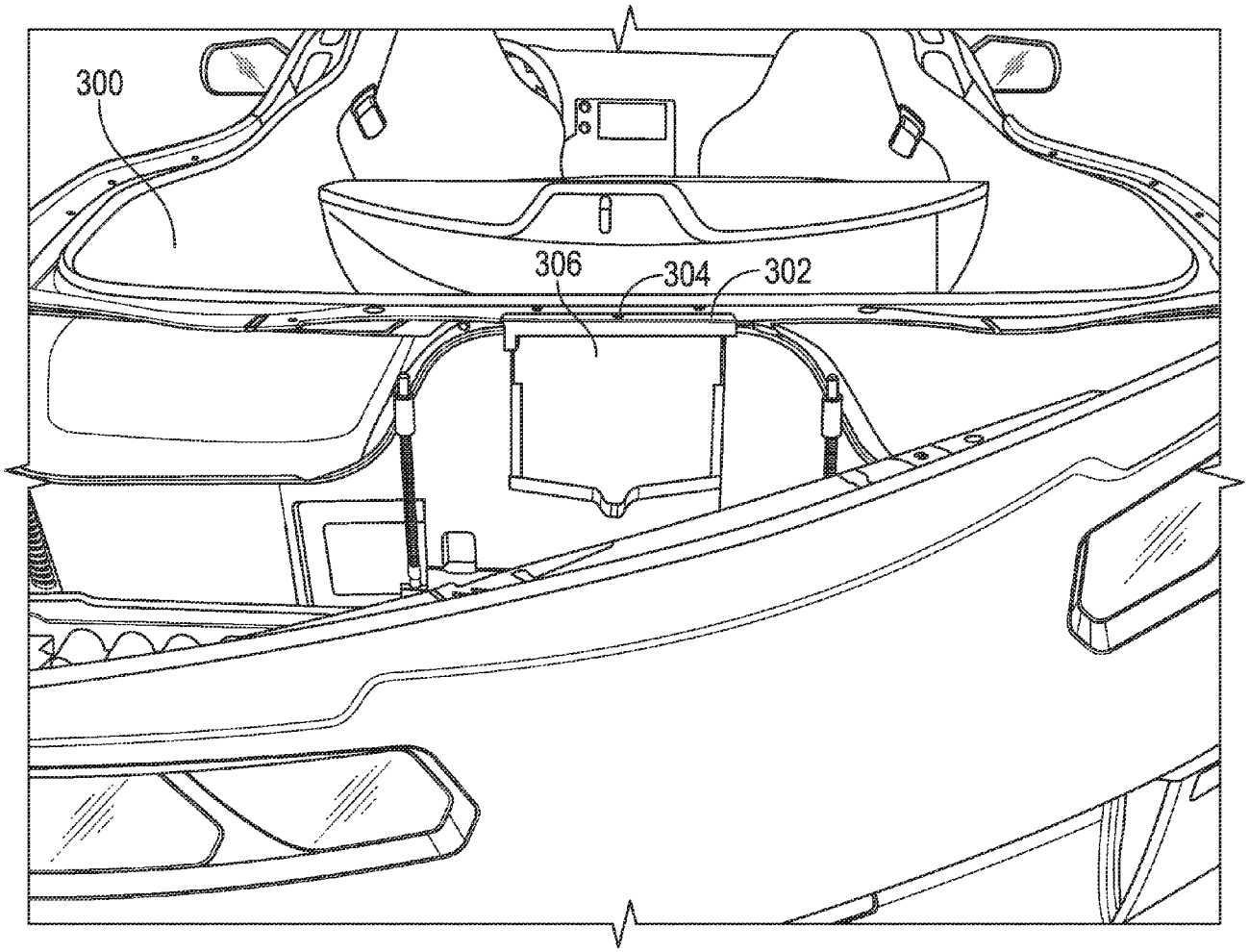
FIG. 3 is a diagram of the back of a vehicle having a plate antenna system installed.

FIG. 3 is a diagram of the back of a vehicle 300 having a plate antenna system installed, as described hereinabove. A first metallic plate 302, a carbon loaded panel 306, and a fastener 304 are shown. The first metallic plate is secured to the carbon loaded panel 306 via fastener 304. The length of the first metallic plate 302 is less than half of the available distance from a first side of the vehicle to a second side of the vehicle, demonstrating a reduction in the plate antenna size requirement pursuant to implementation as described hereinabove.

Thus, there has been provided, a method for increasing automobile plate antenna capture area without increasing the plate antenna size. This method provides the benefit of increased antenna performance and reduced overall weight of the vehicle. Additionally, this method provides the benefit of increasing the options for positioning of the antenna within the vehicle.

While at least one exemplary embodiment has been presented in the foregoing detailed description, it should be appreciated that a vast number of variations exist. For example, the techniques and methodologies presented here could also be deployed as part of a fully automated guidance and display system to allow the flight crew to monitor and visualize the execution of automated maneuvers. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A method for increasing the performance of an automotive plate antenna having a capture area between a first metallic plate and a second plate, the method comprising:

arranging the first metallic plate on a surface of a carbon loaded material, the carbon loaded material (i) positioned between the first metallic plate and the second plate, and (ii) configured to enlarge the capture area between the first metallic plate and the second plate.

2. The method of claim 1, further comprising securing the first metallic plate to the surface of a carbon loaded material.

3. The method of claim 2, wherein the surface of the carbon loaded material is substantially planar and substantially coextensive with the first metallic plate.

4. The method of claim 3, wherein the step of arranging comprises positioning the metallic plate a distance of substantially 0.15 mm from the substantially planar surface of the carbon loaded material.

5. The method of claim 3, wherein the step of securing further comprises securing the metallic plate to the planar surface with a threaded fastener that is substantially centrally positioned on the first metallic plate.

6. The method of claim 1, wherein the carbon content of the carbon loaded material is at least 20%.

7. The method of claim 6, wherein the carbon content is 40-50%.

8. An automotive antenna system comprising:

a plate antenna having a capture area between a first metallic plate and a second plate;

a carbon loaded material having a substantially planar surface positioned between the first metallic plate and the second plate and configured to enlarge the capture area between the first metallic plate and the second plate;

wherein the first metallic plate is arranged proximate to the planar surface of the carbon loaded material; and a fastener coupling the carbon loaded material to the first metallic plate.

9. The system of claim 8, wherein the first metallic plate is separated from the substantially planar surface of the carbon loaded material by a distance of substantially 0.15 mm.

10. The system of claim 8, wherein the fastener comprises at least one threaded fastener.

11. The system of claim 10, wherein the at least one threaded fastener is centrally placed on the first metallic plate and approximately perpendicular thereto.

12. The system of claim 8 wherein the carbon content of the carbon loaded material is at least 20%.

13. The system of claim 8 wherein the carbon loaded material comprises a plurality of particles that exhibit capacitive coupling.

14. The system of claim 10, wherein the distance between the metallic plate and the substantially planar surface of the carbon loaded material is controlled by applying a torque of substantially 9 Nm to the threaded fastener.

15. The system of claim 11, wherein the distance between the metallic plate and the substantially planar surface of the carbon loaded material is controlled by applying a torque of substantially 9 Nm to the threaded fastener.

* * * * *